US008287151B2

(12) United States Patent
Chung et al.

(10) Patent No.: US 8,287,151 B2
(45) Date of Patent: Oct. 16, 2012

(54) ILLUMINATION APPARATUS MODULE

(75) Inventors: Hsien-Tsung Chung, Miao-Li Hsien (TW); Wei-Chun Yeh, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 309 days.

(21) Appl. No.: 12/843,781

(22) Filed: Jul. 26, 2010

(65) Prior Publication Data

US 2011/0134639 A1 Jun. 9, 2011

(30) Foreign Application Priority Data

Dec. 9, 2009 (CN) ..... 2009 1 0311098

(51) Int. Cl.
*F21S 4/00* (2006.01)

(52) U.S. Cl. ..... 362/249.02; 362/249.04

(58) Field of Classification Search ..... 362/249.02, 362/249.04, 218, 249.01, 249.11, 294, 373, 362/547; 411/16, 187
See application file for complete search history.

(56) References Cited

U.S. PATENT DOCUMENTS

| | | | | |
|---|---|---|---|---|
| 7,969,729 | B2 | 6/2011 | Yang | |
| 2010/0165627 | A1 * | 7/2010 | Wung et al. | 362/249.02 |
| 2012/0063137 | A1 * | 3/2012 | Livesay et al. | 362/249.02 |

FOREIGN PATENT DOCUMENTS

| | | |
|---|---|---|
| TW | 391485 | 5/2000 |
| TW | M338318 | 8/2008 |
| TW | M351587 | 2/2009 |
| TW | M353304 | 3/2009 |

* cited by examiner

*Primary Examiner* — Anne Hines
(74) *Attorney, Agent, or Firm* — Altis Law Group, Inc.

(57) ABSTRACT

An illumination apparatus comprises at least two illumination apparatus modules arranged abreast and a connecting element. Each illumination apparatus module includes a cover, a case, and an elastic fastener. A supporting portion is mounted on the case supporting the cover. The sidewall of the case has a first hole, and the supporting portion has a second hole. The elastic fastener is mounted on the second hole. The supporting portion supports the cover and fixes the cover on the case. The connecting element passing through the first holes of the two adjacent sidewalls of two illumination apparatus modules fixes and connects the two illumination apparatus modules together. By the first holes and the connecting element corresponding to the first holes, each illumination apparatus module combines mutually. The elastic fastener fixes the cover and the case together.

11 Claims, 6 Drawing Sheets

ILLUMINATION APPARATUS MODULE

BACKGROUND

1. Technical Field

The disclosure relates to an illumination apparatus, and particularly to an easily assembled illumination apparatus.

2. Description of the Related Art

Light emitting diodes' (LEDs) many advantages, such as high luminosity, low operating voltage, low power consumption, compatibility with integrated circuits, easy driving, long term reliability, and environmental friendliness have promoted their wide use as a light source.

Joseph Bielecki et al in IEEE, 23rd IEEE SEMI-THERM Symposium, "Thermal Considerations for LED Components in an Automotive Lamp." characterize light emitting diodes as one kind of semiconductor device changing current into light of specific wavelength.

For the application of LED, setting up multiple illumination apparatuses to adjust the optical distribution of the light emitting diode is necessary, although it will increase costs. However, there is no modular capability in commonly used illumination apparatus.

What is needed therefore, is a modular illumination apparatus to overcome the described limitations.

BRIEF DESCRIPTION OF THE DRAWINGS

Many aspects of the present illumination apparatus module can be better understood with reference to the following drawings. The components in the drawings are not necessarily drawn to scale, the emphasis instead being placed upon clearly illustrating the principles of the present illumination device. Moreover, in the drawing, like reference numerals designate corresponding parts throughout the several views.

DETAILED DESCRIPTION

Embodiments of the illumination apparatus are described in detail here with reference to the drawings.

Figure 1:
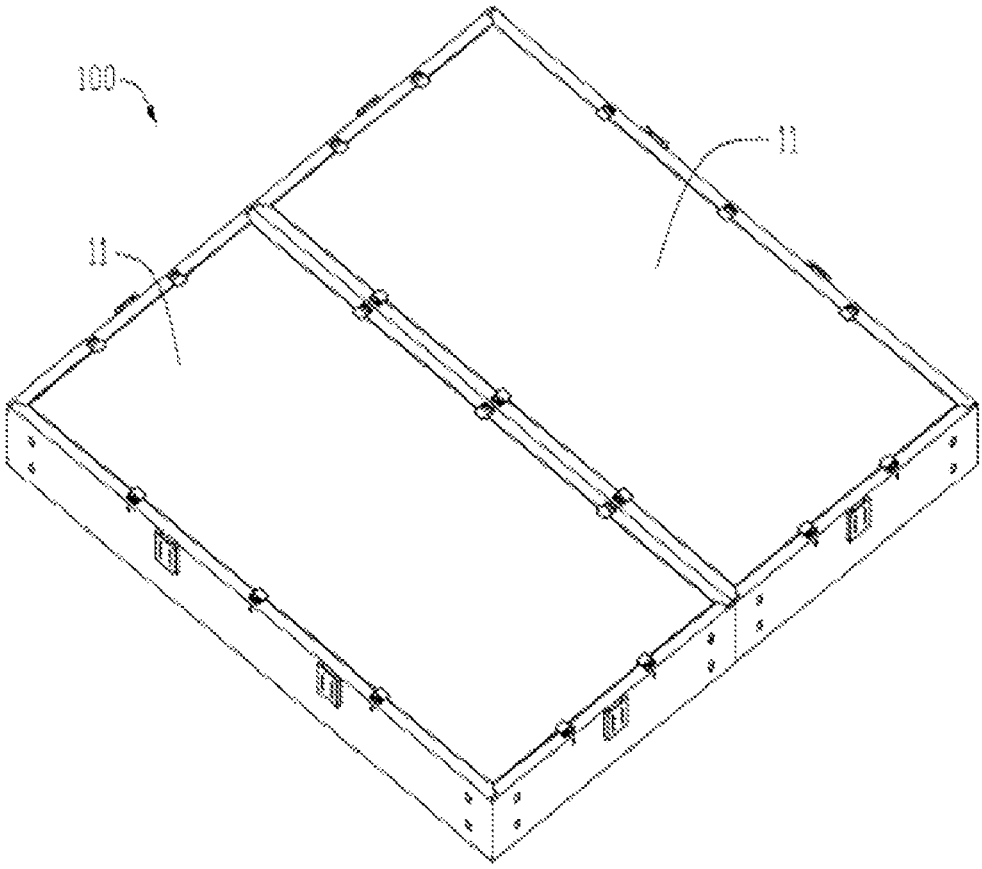
FIG. 1 is a schematic view of an illumination apparatus of a first embodiment.
Figure 2:
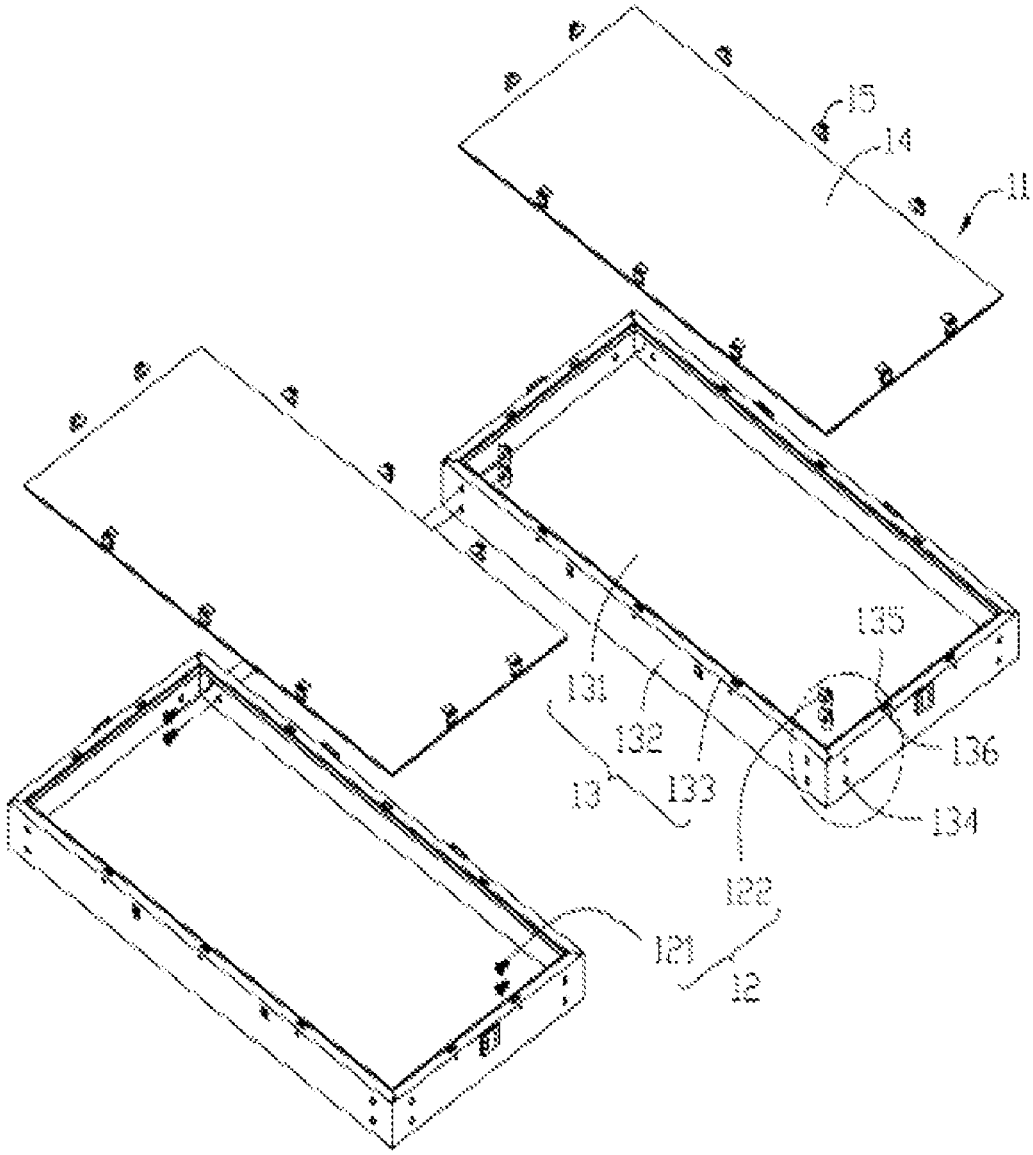
FIG. 2 is an exploded view of the illumination apparatus module of FIG. 1.

Referring to FIG. 1 and FIG. 2, an illumination apparatus 100 according to a first embodiment comprises two illumination apparatus modules 11 and a connecting element 12. The illumination apparatus module 11 includes a case 13, a cover 14, and a plurality of elastic fasteners 15.

Figure 3:
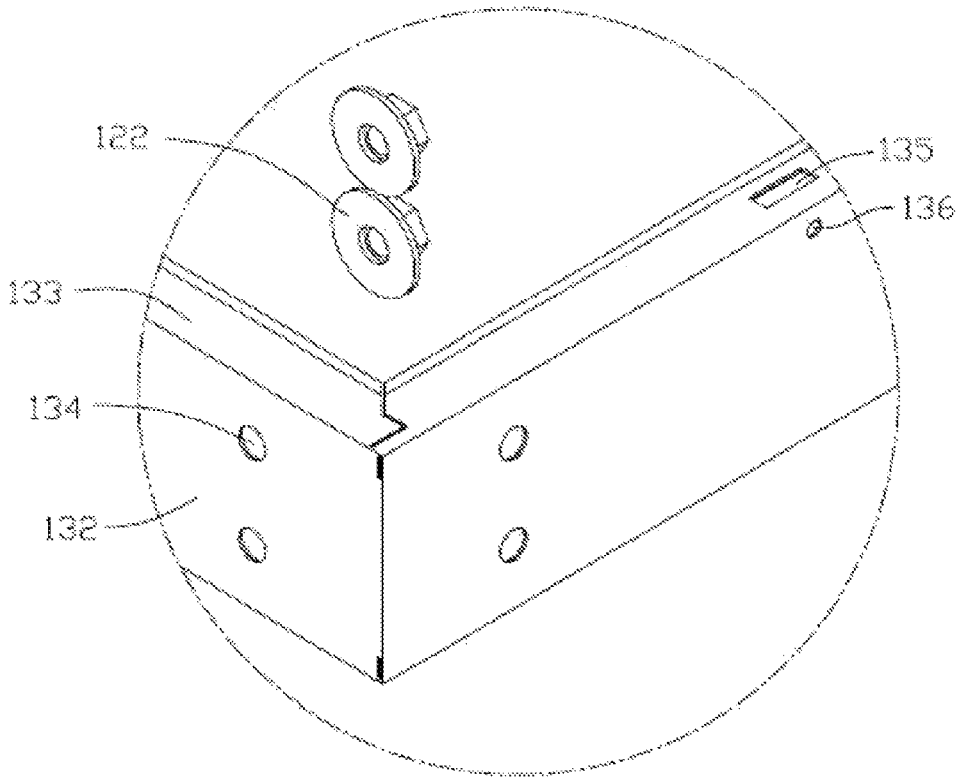
FIG. 3 is an enlarged view of a portion of the illumination apparatus of FIG. 2.

Referring to FIG. 3, the case 13, a rectangular structure, has a bottom surface 131 and four sidewalls 132. The bottom surface 131 and the four sidewalls 132 define a cavity receiving a light source (not shown). A supporting portion 133 on one side of the sidewalls 132 away from the bottom surface 131 extends toward the cavity and bends to support the cover 14. The four sidewalls 132 of the case 13 define at least two first holes; in this embodiment, each sidewall 132 defines four first holes 134 on the four corners of the rectangular sidewall 132. The supporting portion 133 defines at least four second holes, and in this embodiment, the two longer sides of the case 13 each define three second holes 135, and the two shorter sides each define two second holes 135.

The cover 14 is mounted on the opening defined by the bottom surface 131 and the four sidewalls 132, supported by the supporting portion 133. The cover 14, a transparent board, can be resin, epoxy resin, silicone, polymer, transparent polyester optical material, PC (Polycarbonate), PET (Polyethylene terephthalate), or PMMA (polymethyl methacrylate). In this embodiment, the cover 14 is PMMA (polymethyl methacrylate).

The connecting element 12 comprises a fastener 121 and a threaded retainer 122 corresponding thereto. Referring to FIG. 2, the two longer sides of two adjacent illumination apparatus modules 11 are matched, and each of the four first holes 134 of the two illumination apparatus modules 11 mutually correspond. The fasteners 121 pass through the four first holes 134 between the two illumination apparatus modules 11, and then, with the threaded retainers 122, attach the two illumination apparatus modules 11.

Figure 4:
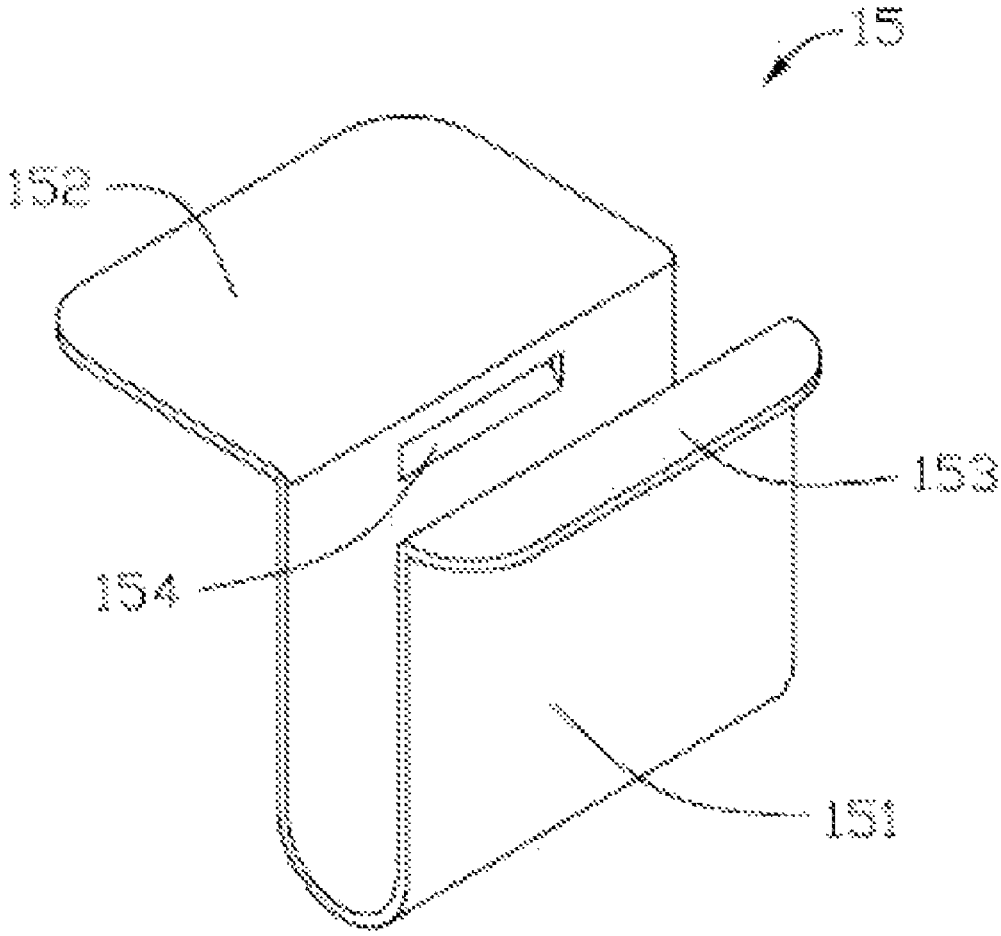
FIG. 4 is an enlarged schematic view of an elastic fastener of the illumination apparatus of FIG. 2.

Referring to FIG. 4, the elastic fastener 15, as a U-shaped elastic piece, includes a U-shaped body 151, a first extension surface 152 and a second extension surface 153 extending from the U-shaped body 151. The first extension surface 152 and the second extension surface 153 are perpendicular to the U-shaped body 151. The extending length of the first extension surface 152 is longer than the second extension surface 153. The elastic fastener 15 fixes the cover 14 on the case 13, as shown in FIG. 2.

First, the cover 14 mounted on the opening part of the cavity of the case 13 is supported by the supporting portion 133. Then, the U-shaped body 151 of the elastic fastener 15 is received in the second hole 135, and the first extension surface 152 covers the outer surface of the case 14 to fix the cover 14 to the case 13 tightly. The second extension surface 153 covers the supporting portion 133 and the elastic fastener 15 does not completely enter into the second hole 135. Due to the elasticity of the U-shaped body 151, the supporting portion 133 holds the cover 14 at the sidewalls 132, and the cover 14 is fixed tightly on the surface of the case 13.

The distance between both sides of the U-shaped body 151 gradually increases from the bottom to the extension surfaces 152, 153. When the U-shaped body 151 is received in the second hole 135, the U-shaped body 151 and the case 13 experience lateral elastic pressure. With the depth of the insertion of the U-shaped body 151 gradually increasing, the contact pressure between the U-shaped body 151 and the case 13 gradually increases. Thus, the friction between the U-shaped body 151 and the case 13 gradually increases. The friction retains the elastic fastener 15 in the second hole 135.

Furthermore, with the contact pressure between the U-shaped body 151 and the case 13, the case 13 and the cover 14 contact tightly.

In addition, in order to prevent the elastic fastener 15 in the second hole 135 from separating, one end of the U-shaped body 151 near the first extension surface 152 is provided with a tongue 154. When the U-shaped body 151 is received completely into the second hole 135, the tongue 154 fixes with the case 13 by engagement with the bottom face of the supporting portion 133. Thus, the elastic fastener 15 remains in the second hole 135 to securely and reliably mount the cover 14 to the case 13.

The distance between the tongue 154 and the first extension surface 152 is equal to or slightly exceeds the thickness of the plate for forming case 13. Preferably, the elastic fastener 15 is metal material exhibiting superior strength and resiliency.

The elastic fastener 15 can alternatively be other fixture element such as a fastener, a threaded retainer or other, not being limited to that of this embodiment.

Preferably, the width of the top portion of the U-shaped body 151 of the elastic fastener 15 exceeds the width of the bottom portion when the elastic fastener 15 is in a natural state. Therefore, the distance between the first extension surface 152 and the second extension surface 153 of the U-shaped body 151 exceeds the width of the bottom portion of the U-shaped body 151. This can increase the contact pressure between the U-shaped body 151 and the case 13.

Preferably, the width of the bottom portion of the U-shaped body 151 of the elastic fastener 15 is less than that of the second hole 135. Thus, the U-shaped body 151 can be received in the second hole 135.

In order to disassemble the elastic fastener 15 conveniently, the sidewall of the case 13 has a corresponding third hole 136. The distance between the third hole 136 and the supporting portion 133 is less than that between the bottom potion of the U-shaped body 151 and the second extension surface 153. The third hole 136 is positioned near the second extension surface 153 when the elastic fastener 15 is securely mounted in the second hole 135.

The third hole 136 allows convenient disassembly of the elastic fastener 15 from the case 13 to separate the cover 14 and the case 13.

During disassembly, a rigid pin-shaped member can be inserted into the third hole 136, pressing one end of the U-shaped body 151, which deforms accordingly to disengage from the supporting portion 133 defining the second hole 135.

When the deformation of the U-shaped body 151 is sufficient, the second extension surface 153 of the elastic fastener 15 moves into the second hole 135, and the elastic fastener 15 is disassembled and separates, being received into the inside of the case 13, being easily retrievable.

The illumination apparatus 100 further includes a light source (not shown). The light source can be light emitter diode, laser, or organic light emitting diode. The light source is mounted inside the case 13 and light therefrom passes through the cover 14.

Understandably, the connecting element 12 can alternatively comprise connecting elements other than a fastener and threaded retainer, not being limited thereto.

Figure 5:
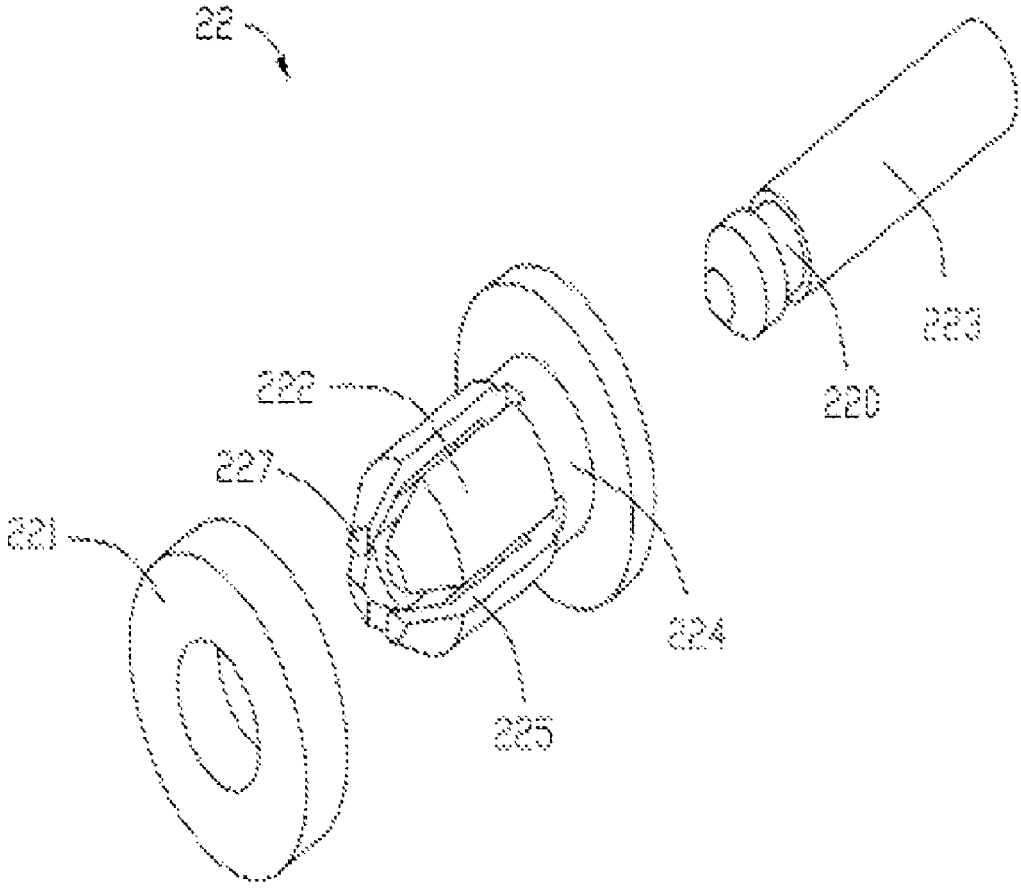
FIG. 5 is an enlarged schematic view of a connecting element of the illumination apparatus of FIG. 2 in accordance with a modified embodiment.

Referring to FIG. 5, a connecting element 22, a group of plastic parts in accordance with a second embodiment, includes an O-ring 221, a hollow engaging suite 222 having an annular blocking portion, and a solid post 223. One end of the hollow engaging suite 222 near the annular blocking portion has an annular cavity 224. The width of the annular cavity 224 exceeds the thickness of the O-ring 221. The top portion of the hollow engaging suite 222 has a gap 225. The depth of the gap 225 extends from the top portion of the hollow engaging suite 222 to the annular cavity 224.

In this embodiment, the gap 225 forms the shape of a cross, and the solid post 223 spreads the gap 225. The gap 225 can alternatively be of other shapes such as an I, triangle, or other, not being limited to that of this embodiment.

The hollow engaging suite 222 passing through the corresponding first holes 134 of the two illumination apparatus modules 11 combines the O-ring 221. The O-ring 221 is positioned on the hollow engaging suite 222 with the annular blocking portion respectively in the two illumination apparatus modules 11.

The solid post 223 is received in the through hole of the hollow engaging suite 222 from one side of the annular blocking portion. After the solid post 223 is received in the gap 225, the solid post 223 will spread the gap 225. Then, the O-ring 221 is stuck by the annular cavity 224.

With the O-ring 221, the hollow engaging suite 222, and the solid post 223, the two adjacent illumination apparatus modules 11 are combined. To fix the solid post 223 in the hollow engaging suite 222, an annular groove 220 is set on one end of the solid post 223. An engaging hook 227 is set in the gap 225 of the hollow engaging suite 222. When the top portion of the solid post 223 is at the corresponding location, the engaging hook 227 of the gap 225 is embedded in the ring groove 220. Therefore, the hollow engaging suite 222 is fixed in the corresponding location. The sidewalls 132 of the cases 13 of the two connected illumination apparatus modules 11 are blocked between the O-ring 221 and the annular blocking portion of the hollow engaging suite 222.

Figure 6:
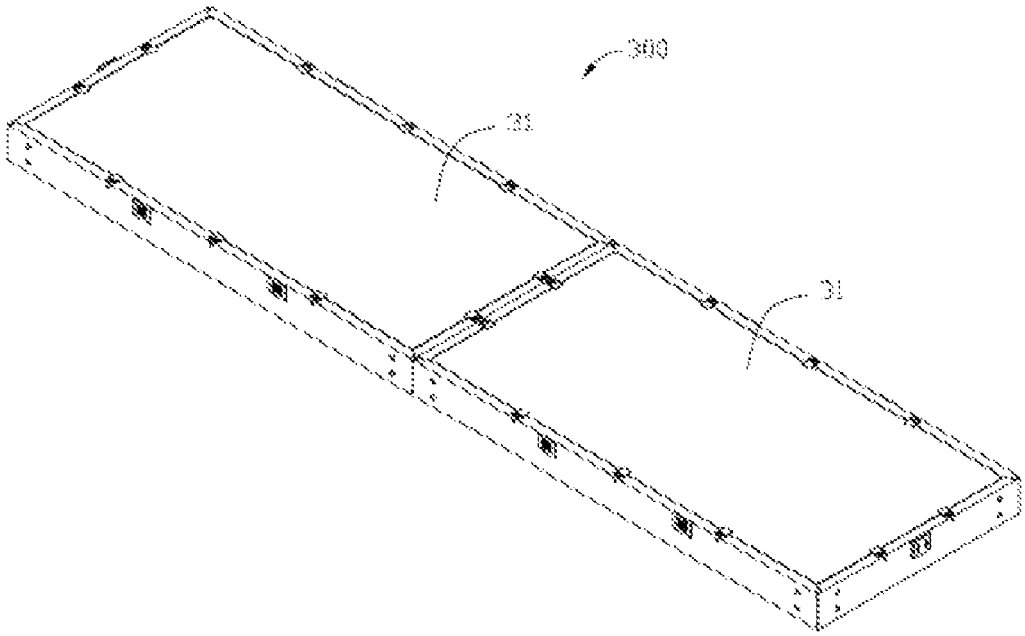
FIG. 6 is a schematic view of the illumination apparatus of FIG. 1 in another arrangement.

Each illumination apparatus module 11 can be connected by the short sides mutually. Referring to FIG. 6, the illumination apparatus 300 of another arrangement includes two illumination apparatus modules 31, and the two illumination apparatus modules 31 are connected by the short sides mutually.

The illumination apparatus 100 (300) is not limited to two illumination apparatus modules 31, and can be three or more. With the connecting element 12 (22), the illumination apparatus modules 31 are combined mutually.

The illumination apparatus module is not limited to a rectangular solid, and can be other shapes, such as a triangular prism, a hexagonal prism, or other configuration. A plurality of illumination apparatus modules can connect mutually by the connecting element.

While certain embodiments have been described and exemplified, various other embodiments from the foregoing disclosure will be apparent to these skilled in the art. The disclosure is not limited to the particular embodiments described and exemplified but is capable of considerable variation and modification without departure from the scope of the appended claims.

What is claimed is:

1. An illumination apparatus comprising at least two illumination apparatus modules arranged abreast and a connecting element, wherein each illumination apparatus module includes a case, a cover, and an elastic fastener, the case and the cover defining a cavity for receiving a light source, the case including a bottom surface and sidewalls, a supporting portion extending and bending toward the cavity mounted on one end of the sidewall away from the bottom surface, the sidewalls of the case defining a first hole, the supporting portion defining a second hole, the elastic fastener received in the second hole for the supporting portion supporting the cover and fixing the cover on the case, and the connecting element passing through the first holes of adjacent two sidewalls of the at least two illumination apparatus modules for combining together.

2. The illumination apparatus of claim 1, wherein the light source is light emitting diode, organic light emitting diode, or laser.

3. The illumination apparatus of claim 1, wherein the connecting element is a group of fastener and threaded retainer.

4. The illumination apparatus of claim 1, wherein the connecting element includes a O-ring, a hollow engaging suite, and a solid post, one end of the hollow engaging suite defines a gap, another end of the hollow engaging suite comprises an annular blocking portion, the hollow engaging suite passing through the first holes of the adjacent sidewalls of the at least two illumination apparatus modules, the O-ring and the annular blocking portion received respectively in the two sides of two adjacent sidewalls, the O-ring received in one end of the hollow engaging suite having the gap, and the solid post passing through the hollow engaging suite spreading the gap and fixing the hollow engaging suite with the O-ring.

5. The illumination apparatus of claim 4, wherein the one end of the hollow engaging suite near the annular blocking portion defines an annular cavity to fix the O-ring.

6. The illumination apparatus of claim 4, wherein the one end of the solid post defines an annular groove, the hollow engaging suite forms an engagement hook, and when the solid post is received in the corresponding hollow engaging suite, the engagement hook is embedded in the annular groove.

7. The illumination apparatus of claim 1, wherein the elastic fastener includes a U-shaped body and a first and a second extension surface extending from the U-shaped body, the first and the second extension surfaces are perpendicular to the U-shaped body, and the width of bottom of the U-shaped body is less than the width of the second hole for the U-shaped body received in the second hole.

8. The illumination apparatus of claim 7, wherein the width of the top portion of the U-shaped body exceeds the width of the bottom portion of the U-shaped body when the elastic fastener is in a natural state, and the lateral elastic pressure between the U-shaped body and the case combines the U-shaped body with the case.

9. The illumination apparatus of claim 7, wherein the one end of the U-shaped body near the first extension surface comprises a tongue, a distance between the tongue and the first extension surface is substantially equal to a thickness of a plate for forming the case, the tongue fixes the elastic fastener in the case, and the first extension surface extends toward the cover.

10. The illumination apparatus of claim 7, wherein a third hole is mounted on the sidewall of the case corresponding to the position of the elastic fastener, and the distance between the third hole and the supporting portion is less than the distance between the bottom portion of the U-shaped body and the second extension surface.

11. The illumination apparatus of claim 1, wherein the cover is resin, epoxy resin, silicone, polymer, transparent polyester optical material, PC (Polycarbonate), PET (Polyethylene terephthalate), or PMMA (polymethyl methacrylate).

* * * * *